US009988845B2

(12) United States Patent
Pierce

(10) Patent No.: US 9,988,845 B2
(45) Date of Patent: Jun. 5, 2018

(54) VIBRATING SOIL PROBE

(71) Applicant: Jack D. Pierce, Greeneville, TN (US)

(72) Inventor: Jack D. Pierce, Greeneville, TN (US)

( * ) Notice: Subject to any disclaimer, the term of this patent is extended or adjusted under 35 U.S.C. 154(b) by 159 days.

(21) Appl. No.: 14/682,180

(22) Filed: Apr. 9, 2015

(65) Prior Publication Data

US 2015/0292267 A1 Oct. 15, 2015

Related U.S. Application Data

(60) Provisional application No. 61/977,132, filed on Apr. 9, 2014.

(51) Int. Cl.
*E21B 7/26* (2006.01)
*E21B 7/02* (2006.01)

(52) U.S. Cl.
CPC ..... *E21B 7/028* (2013.01)

(58) Field of Classification Search
CPC ..... E21B 7/028
USPC ..... 175/19
See application file for complete search history.

(56) References Cited

U.S. PATENT DOCUMENTS 2,641,982 A 6/1953 Harshberger
2,667,752 A 2/1954 Moseley
3,278,235 A 10/1966 Berstrom
3,303,656 A 2/1967 Landau
3,747,687 A 7/1973 Bodine
3,865,501 A 2/1975 Kniep
4,126,007 A * 11/1978 Mars ..... E02D 3/08 405/240
4,445,788 A * 5/1984 Twersky ..... A01G 1/00 374/110
4,852,512 A * 8/1989 Klatt ..... G09F 17/00 116/173
5,186,263 A 2/1993 Kejr
5,358,062 A * 10/1994 Uhl ..... E21B 3/035 173/178
5,435,399 A * 7/1995 Peterson ..... E02D 1/04 175/135
5,697,733 A 12/1997 Marsh, Jr.
6,155,708 A 12/2000 Lindley
6,959,245 B2 * 10/2005 Rooney ..... G01V 11/00 700/283
7,040,146 B2 5/2006 Mackenzie
7,699,119 B1 * 4/2010 Lunde ..... E21B 17/046 175/18
8,579,040 B2 11/2013 Sedmak
(Continued)

FOREIGN PATENT DOCUMENTS

DE 3728669 3/1989

*Primary Examiner* — Taras P Bemko
(74) *Attorney, Agent, or Firm* — Matthew M. Googe; Robinson IP Law, PLLC

(57) ABSTRACT

A vibrating soil is provided for locating one or more underground utility conduits. The vibrating soil probe includes a handle, an elongate rigid probe body attached to the handle at a proximal end of the probe body, a probe head attached to a distal end of the probe body, a drive shaft attached to a motor at a first end of the drive shaft, the driveshaft disposed within the elongate rigid probe body, and a vibration mechanism disposed within the probe head, the vibration mechanism attached to a second end of the drive shaft. The vibration mechanism induces a vibration in the probe head of the soil probe to enable the probe head to penetrate the soil.

14 Claims, 5 Drawing Sheets

(56) References Cited

U.S. PATENT DOCUMENTS

| | | | | |
|---|---|---|---|---|
| 8,955,401 | B1 * | 2/2015 | Burton | G01N 1/08 175/20 |
| 2004/0177672 | A1 * | 9/2004 | Schmitt | G01N 1/2294 73/19.1 |
| 2006/0254818 | A1 * | 11/2006 | Pepple | A01K 97/01 175/18 |
| 2008/0190667 | A1 * | 8/2008 | Pflieger | E21B 11/005 175/57 |
| 2012/0195156 | A1 | 8/2012 | Oswald | |

* cited by examiner

VIBRATING SOIL PROBE

CROSS-REFERENCE TO RELATED APPLICATIONS

This application claims priority to U.S. Application Ser. No. 61/977,132 to Jack D. Pierce entitled "Vibrating Soil Probe" which was filed on Apr. 9, 2014, the content of which is incorporated herein by reference in its entirety.

FIELD

This disclosure relates to the field of soil or earth probes. More particularly, this disclosure relates to a vibrating soil or earth probe for locating underground utilities (e.g. pipelines, electrical cable, conduit, drain tile and other buried structures) or otherwise boring into earth or soil.

BACKGROUND

Locating, identifying and marking underground utilities is one of the most important steps before beginning a construction project when underground utilities are in the vicinity or when repairing an underground utility. However, locating underground utilities may be a difficult process requiring probing of soil around the underground utilities. Typically the soil around an underground utility is compacted, thereby making insertion of a probe into the soil difficult without applying a great amount of force to the probe. This force will increase the likelihood of damaging an underground utility should the probe contact the utility.

Care must be taken to avoid damaging an underground utility conduit when probing the adjacent soil. A typical soil probe is formed of a handle and shaft with a pointed tip at the end of the shaft, wherein the shaft must be manually inserted into the soil by a user. However, when a typical soil probe is inserted into the soil with enough force, such that the probe penetrates the soil, the force applied to the probe may be sufficient to penetrate and/or damage the underground utility conduit that the user is attempting to locate. Soil conditions may exist that make insertion of the soil probe difficult. Further, the force required to penetrating soil with a typical soil probe require greater exertion by users attempting to insert a probe into the soil.

What is needed therefore, is a portable vibrating soil probe for penetrating soil adjacent an underground utility conduit without damaging the utility.

SUMMARY

The above and other needs are met by a vibrating soil or earth probe for boring into soil. In one aspect, the vibrating soil probe includes a handle, an elongate rigid probe body attached to the handle at a proximal end of the probe body, a probe head attached to a distal end of the probe body, a drive shaft attached to a motor at a first end of the drive shaft, the driveshaft disposed within the elongate rigid probe body, and a vibration mechanism disposed within the probe head, the vibration mechanism attached to a second end of the drive shaft. The vibration mechanism induces a vibration in the probe head of the soil probe to enable the probe head to penetrate the soil.

In one embodiment, the motor of the soil probe is attached adjacent the handle of the soil probe. In another embodiment, the handle includes a gripping surface, a handle hub, one or more grip support members securing the gripping surface to the handle hub, and a motor output shaft adjacent the handle hub.

In yet another embodiment, the probe further includes one or more batteries for powering the motor. In one embodiment, the one or more batteries are attached to the one or more grip support members of the handle. In another embodiment, the handle is substantially circular shaped.

In yet another embodiment, the drive shaft has a diameter that is less than a diameter of the probe head. In one embodiment, the vibration mechanism comprises a rotating eccentric weight, the rotating eccentric weight secured to the second end of the elongate drive shaft.

In another embodiment, the probe further includes a probe body disconnect, the probe body disconnect including a disconnect body, an insert, and a fastener, wherein the insert is attached to one of the probe body or handle and is removably inserted into the disconnect body, which is attached to one of the probe body or handle, and the fastener maintains the insert within the disconnect body such that the probe body is readily detachable from the handle.

In one embodiment, the probe head includes a substantially tapered probe head body. In another embodiment, the probe head body is formed of a nonconductive material. In yet another embodiment, the probe head is removably attached to the rigid probe body. In one embodiment, the probe head is threadably attached to the rigid probe body.

In another aspect, a soil probe is provided including: a handle, the handle including a gripping surface, a handle hub, one or more grip support members securing the gripping surface to the handle hub and a motor output shaft adjacent the handle hub; an elongate rigid probe body secured adjacent to the handle hub of the handle; an elongate drive shaft secured to the motor output shaft and extending within the probe body; and a vibrating probe head secured adjacent, a distal end of the probe body and elongate drive shaft, the vibrating probe head including a rotating eccentric weight, wherein the rotating eccentric weight is secured to the elongate drive shaft. The vibrating probe head has a diameter that is greater than a diameter of the elongate rigid probe body. The rotating eccentric weight induces a vibration in the probe head of the soil probe to enable the probe head to penetrate the soil.

In yet another aspect, a soil probe is provided including: a circular handle, the handle including a gripping surface, a handle hub, one or more grip support members securing the gripping surface to the handle hub and a motor output shaft adjacent the handle hub, the handle further including a motor attached adjacent the handle hub and one or more batteries attached to the handle; an elongate rigid probe body removably attached to the handle hub of the handle; an elongate drive shaft removably attached to the motor output shaft and disposed within the probe body; and a vibrating probe head removably attached to a distal end of the probe body and elongate drive shaft, the vibrating probe head including a rotating eccentric weight, wherein the rotating eccentric weight is attached to the elongate drive shaft. The vibrating probe head has a diameter that is greater than a diameter of the elongate rigid probe body. The rotating eccentric weight induces a vibration in the probe head of the soil probe to enable the probe head to penetrate the soil.

The above and other needs are met by a vibrating soil or earth probe for boring into soil. In one aspect, the vibrating soil probe includes a handle, an elongate rigid probe body attached to the handle at a proximal end of the probe body, a probe head attached to a distal end of the probe body, a drive shaft attached to a motor at a first end of the drive shaft, the driveshaft disposed within the elongate rigid probe body, and a vibration mechanism disposed within the probe head, the vibration mechanism attached to a second end of the drive shaft. The vibration mechanism induces a vibration in the probe head of the soil probe to enable the probe head to penetrate the soil.

BRIEF DESCRIPTION OF THE DRAWINGS

Referencing the following detailed description, appended claims and accompanying figures will better explain the features, aspects and advantages of the present disclosure. The elements are not to scale so as to more clearly show the details, wherein like reference numbers indicate like elements throughout the several views, and wherein:

DETAILED DESCRIPTION

Various terms used herein are intended to have particular meanings. Some of these terms are defined below for the purpose of clarity. The definitions given below are meant to cover all forms of the words being defined (e.g., singular, plural, present tense, past tense). If the definition of any term below diverges from the commonly understood and/or dictionary definition of such term, the definitions below control.

Figure 1:
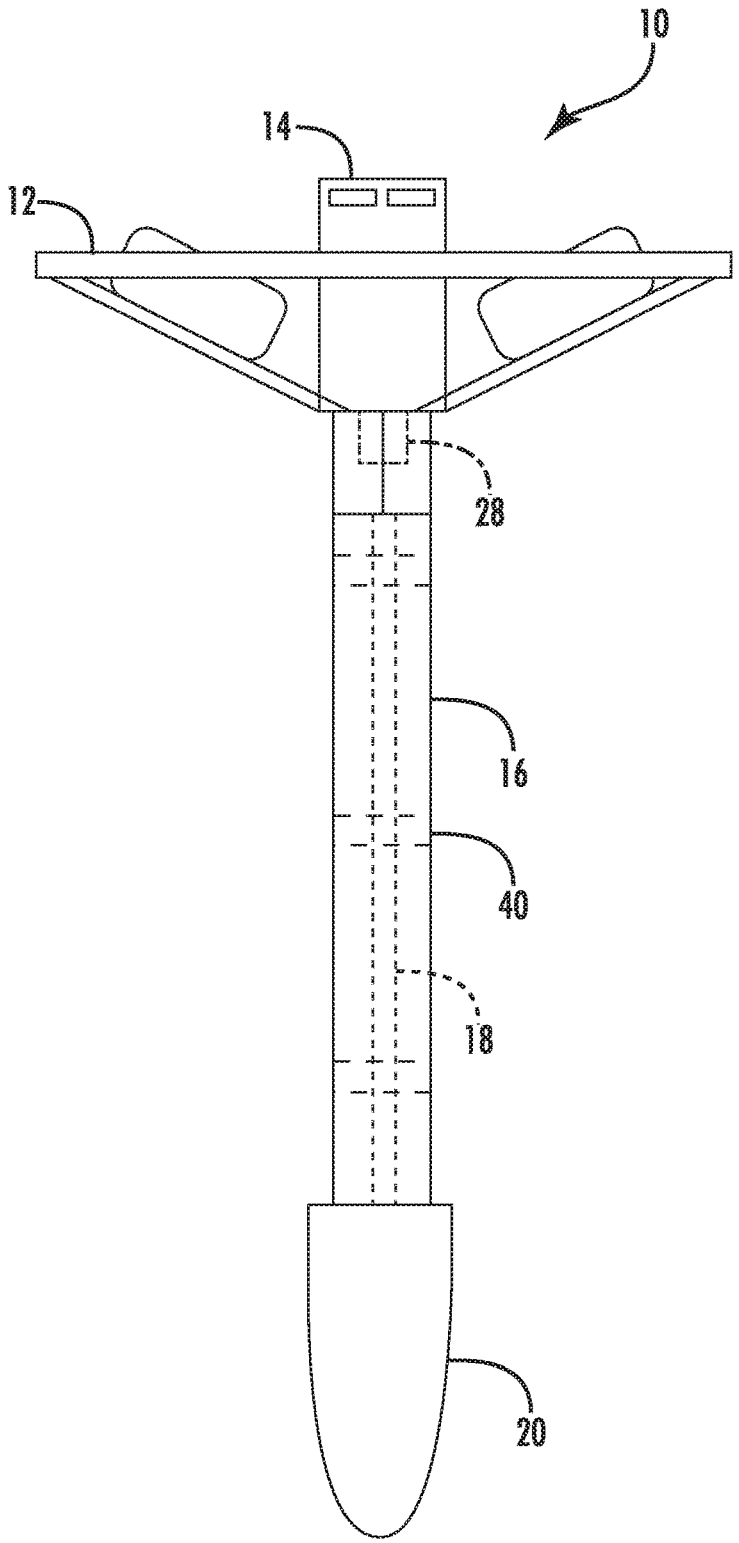
FIG. 1 shows a vibrating soil probe according to one embodiment of the present disclosure.

FIG. 1, which is not drawn to scale, shows a basic embodiment of a vibrating soil probe 10, including a handle 12, a motor 14, probe body 16 secured to the handle 12, a drive shaft 18 coupled to the motor 14, and a probe head 20 secured to a distal end of the probe body 16. The motor 14 powers the drive shaft 18 and a vibration mechanism secured to an end of the drive shaft 18 within the probe head 20. The probe head 20, which vibrates during operation, contacts the adjacent soil and allows the probe 10 to be readily inserted into the soil.

Figure 2:
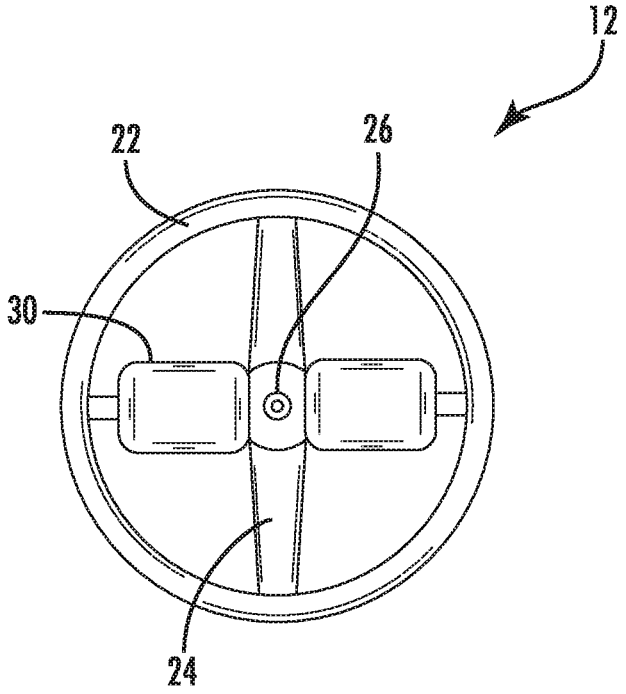
FIGS. 2 and 3 show a handle of a vibrating soil probe according to one embodiment of the present disclosure.
Figure 3:
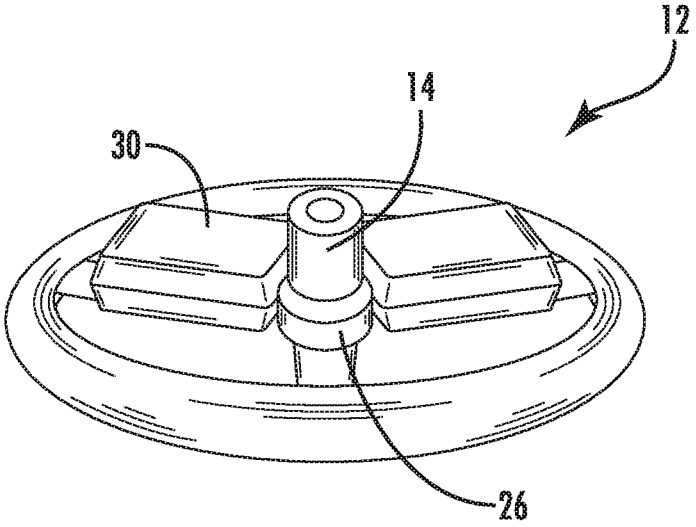

The handle 12 is formed such that a user may grasp the handle 12 to insert the probe 10 into the soil. Preferably the handle 12 is formed into a wheel or circular shape as shown in FIGS. 2 and 3 such that a large surface area is provided for the user to grasp the handle 12 and manipulate the probe 10. The handle includes a gripping surface 22 and one or more grip support members 24 secured to the grip surface 22. The grip support members 24 converge at a handle hub 26 centrally located on the handle 12. While the handle is preferably circular as illustrated in FIGS. 2 and 3, it is also understood that the handle may be substantially "T" or "H" shaped or other like shapes suitable for grasping and manipulation by a user of the probe 10.

With further reference to FIGS. 2 and 3, the motor 14 is secured adjacent the handle hub 26 of the handle 12. The motor 14 is preferably comprised of an 18 volt DC electric motor and is configured to drive an output hub 28 (FIG. 1) at a rate of from about 10,000 RPM to about 21,000 RPM. Referring again to FIG. 1, the motor 14 may be secured on a top side of the handle 12 adjacent the handle hub 26 such that the output hub 28 of the motor 14 extends through the handle 12. An exemplary motor suitable for use in the probe 10 is Model No. RS775VC available from Mabuchi Motor Co., Ltd. of Japan.

The motor 14 is powered by one or more batteries 30 in electrical communication with the motor 14, the one or more batteries 30 secured to the grip support members 24 as shown in FIGS. 2 and 3. The batteries 30 are preferably rechargeable 18-volt batteries suitable for powering the motor 14. An exemplary battery for use in the probe 10 is Model No. BL1830 18-Volt Lithium Ion Battery available from Makita U.S.A., Inc. In alternative embodiments, the motor 14 is powered by an external power source, such as from a 120-volt wall outlet or other like power sources. A switch or other actuator may be secured to the handle 12 and be in communication with the one or more batteries 30 and motor 14 to activate the motor 14.

Alternatively, the probe 10 may be in communication with an external power unit located remotely from the probe 10. The external power unit is in communication with the output hub 28 such that the external power unit rotates the drive shaft 18. The external power unit may supply rotational power to the drive shaft via a flexible shaft that allows the probe to remain substantially portable while powered by the external power source. By using an external power unit and flexible shaft to power the probe 10, an overall weight of the probe may be substantially reduced.

Referring again to FIG. 1, the drive shaft 18 is secured to the output hub 28 of the motor 14 at a first end of the drive shaft 18 and the probe body 16 is secured to the handle 12 of the probe 10 at a first end of the probe body 16. The drive shaft 18 is preferably formed of an elongate flexible cable, metal shaft, nonconductive bar, or other like structure. The probe body 16 is preferably formed of a rigid elongated tube made of a metal pipe or alternatively, formed of a nonconductive tube such as fiberglass tubing, fiberglass rods and other various composite materials, such that the probe body 16 maintains its shape when the probe 10 is in use. The probe body 16 and drive shaft 18 preferably have a length of from about five feet to about ten feet, however, it is also understood that the length of the probe body 16 and drive shaft 18 may be varied depending on the desired use of the probe 10. The drive shaft 18 extends through a length of the probe body 16 and may be supported by one or more bearings 40 secured within the probe body 16, as shown in FIG. 1.

Figure 4:
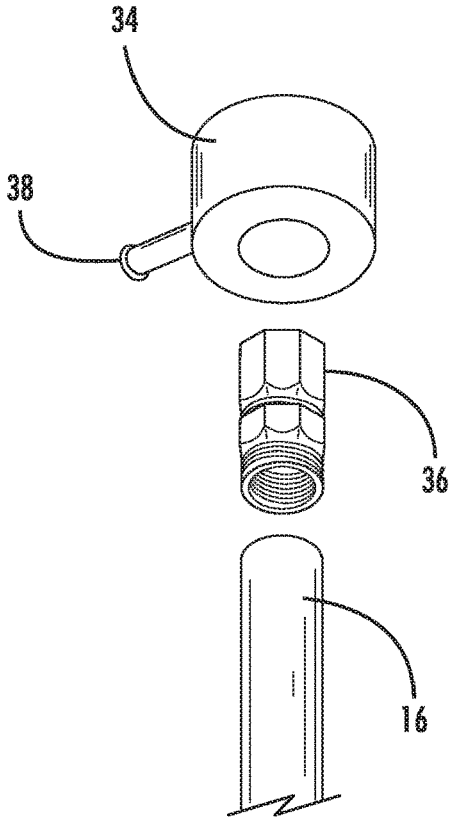
FIGS. 4 and 5 show a probe body disconnect according to one embodiment of the present disclosure.
Figure 5:
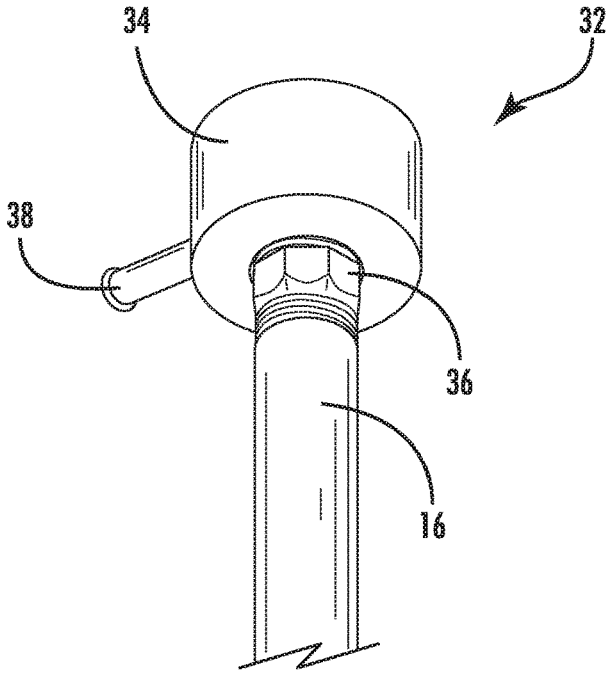

The probe 10 includes a probe body disconnect 32 as shown in FIGS. 4 and 5 for the ability to connect and disconnect the drive shaft 18 and probe body 16 from the handle 12 of the probe unit. The disconnect 32 includes a disconnect body 34, an insert 36, and a fastener 38. The fastener 38 is for securing the disconnect body 34 to the insert 36. The insert 36 is secured to the probe body 16, such as by welding or with one or more fasteners, such that a portion of the insert 36 extends out of the end of the probe body 16. The disconnect body 34 is secured to the handle 12 adjacent the handle hub 26 and engages the portion of the insert 36 that extends from the end of the probe body 16. The insert 36 is preferably keyed to fit within the disconnect body 34 such that the probe body 16 does not twist or rotate while the probe 10 is in use. The fastener 38 extends through the disconnect body 34 and contacts the insert 36 such that the fastener 38 secures the insert 36 within the disconnect body 34.

Figure 6:
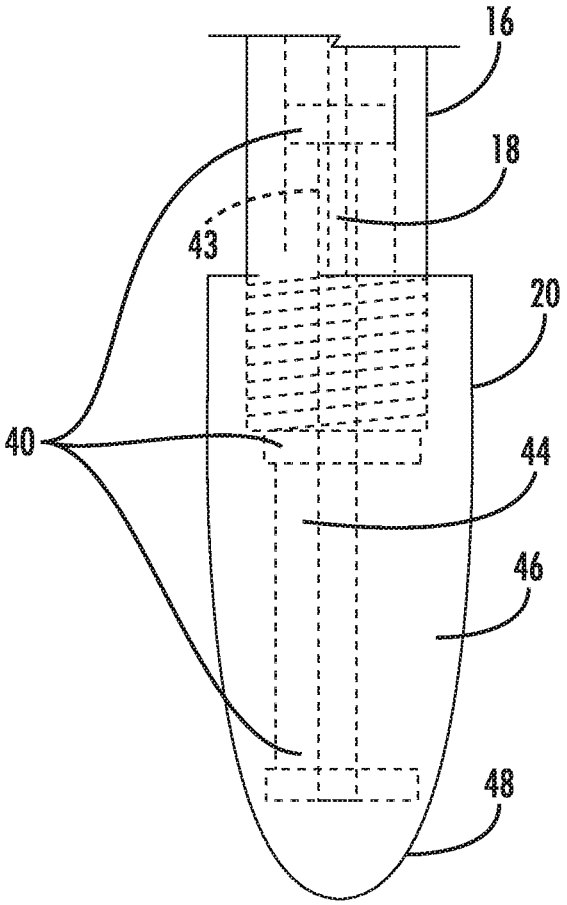
FIG. 6 shows a probe head according to one embodiment of the present disclosure.

Referring now to FIG. 6, the probe head 20 is secured to a second end of the probe body 16 and drive shaft 18. The drive shaft 18 is inserted into keyed engagement 43. The probe body 16 is threaded into the probe head 20 to secure the probe head 20 to the probe body 16. An elongate eccentric weight 44 is secured to the drive shaft 18 via the keyed engagement 43. The probe head 20 includes a probe head body 46 that includes a first end adjacent the drive shaft 18 and a tapered end 48, wherein the tapered end is preferably substantially blunt shaped to prevent damage to any utility that the probe head 20 contacts. The probe head body 46 preferably has an approximate width greater than the width of the probe body 16, preferably ½" to 2" and in approximate length of 5" to 15". The probe head body 46 is preferably formed of a nonconductive material such as a polymer or composite material. Alternatively, the probe head body 46 may be formed of steel or other like metals and coated with a nonconductive material such as a rubber or other like compound.

In one embodiment, a typical concrete vibrator head may be secured to the end of the probe body 16 and drive shaft 18. For example, a suitable concrete vibrator head is available from Oztec Industries, Inc. Suitable models of concrete vibrator heads include the RubberHead™, the Steel Head and Pencil Head vibrator heads. The drive shaft 18 and probe body 16 are configured to accept concrete vibrator heads.

In another embodiment, a damper is positioned between the probe head 20 and rigid probe body 16. The damper is preferably formed of an elastomer or other like material. The damper is configured to reduce the transmission of vibrations along the probe body 16 to the handle 12 such that vibrations felt by a user are substantially reduced. While the above description contemplates installing the damper between the probe head 20 and probe body 16, it is also understood that the damper may be installed along a length of the probe body 16, or that the damper may be positioned adjacent the handle 12 of the soil probe 10.

Figure 7:
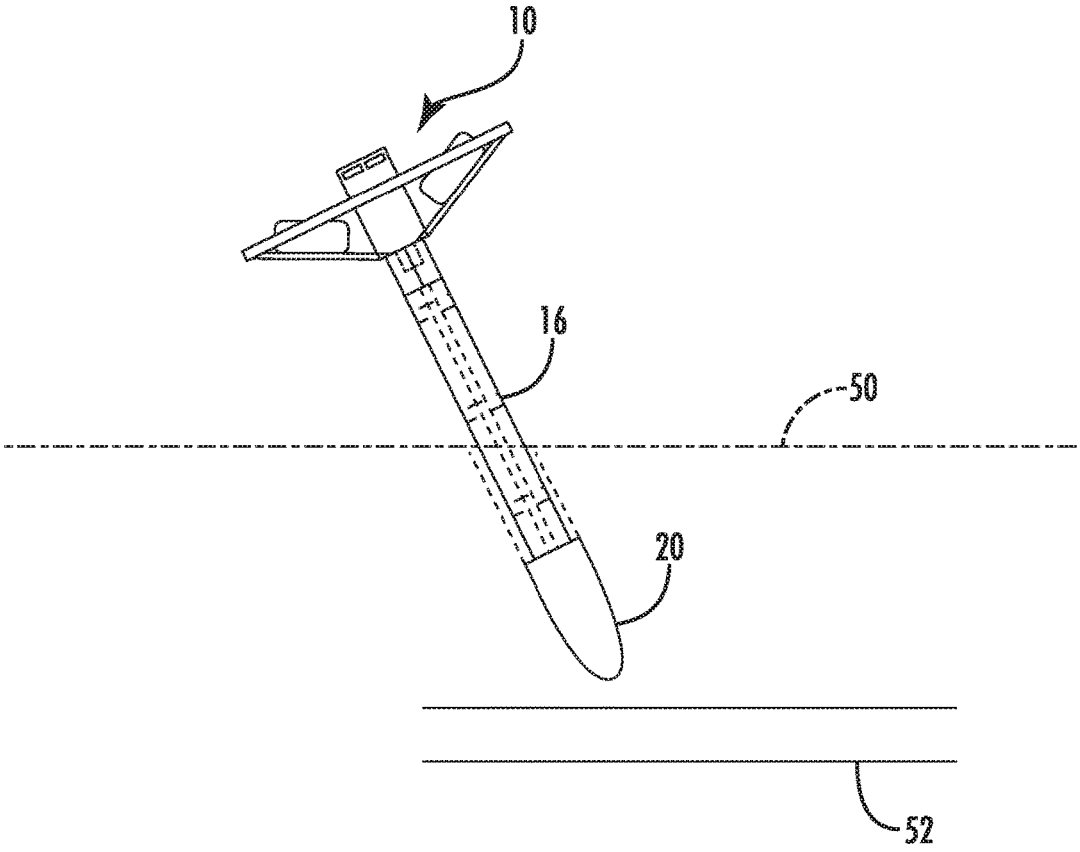
FIG. 7 shows a vibrating soil probe engaged with a soil surface adjacent a utility according to one embodiment of the present disclosure.

Referring to FIG. 7, when in operation, the motor 14 rotates the drive shaft 18 located within the probe body 16, which in turn rotates the eccentric weight 44 within the probe head body 46. The motor rotates the eccentric weight 44 at a rate of from approximately 10,000 RPM to approximately 21,000 RPM. When the vibrating probe head 20 contacts a soil surface 50 adjacent to a utility 52, the probe head 20 easily penetrates the soil as it vibrates. The vibration is caused by the eccentric weight 44 within the probe head 20. As the probe head 20 is inserted into the soil, the probe body 16 readily follows the probe head 20 into the soil because the probe head 20 has a larger diameter than the probe body 16. The centrifugal vibrations caused by the probe head 20 create an enlarged bore hole 54 through the soil as the probe advances, thereby allowing the user to advance the probe 10 with minimum pressure required on the probe. The vibrating probe head 20 agitates and in some instances compacts soil adjacent the probe head, thereby easing entry of the probe head 20 into and through the soil. The user then locates the utility 52 when the probe contacts the utility and the probe is prevented from advancing any further.

The probe head 20 is preferably removably attached to the probe body 16. Various probe heads 20 may be attached to the probe body 16 for different types of soil or surfaces. For example, probe heads having different shapes and sizes may be attached to the probe body 16. Similarly, probe heads having various sizes of eccentric weights 44 may be provided for providing varying strengths of vibrations. Because the probe body 16 may be removably attached to the handle 12, various probe bodies may be provided having varying lengths for different applications. Further, the removable probe body 16 and probe head 20 allow the probe 10 to be substantially modular such that the probe 10 may be broken down into its various components, thereby making the probe 10 substantially portable.

In one embodiment of this device, the vibrating soil probe 10 further includes a water jet secured adjacent to or within the probe head 20 and in communication with a water source. The water jet ejects water from the probe head 20 to further facilitate the probe head 20 penetrating a soil surface 50 and to further facilitate the probe body 16 passing through the bore 54.

While the above description contemplates a probe head that induces vibrations by a rotating centrifugal eccentric weight powered by a drive shaft and motor, it is also understood that various other mechanisms may be employed in the probe head to induce the desired vibrations. For example, a pneumatic vibration mechanism may be placed within the probe head, or other like vibrating structures.

An objective of the probe 10 is to allow a user to easily penetrate soil adjacent to a subterranean utility that the user is attempting to locate while preventing damage to the utility when the probe head 20 contacts the utility. The probe is substantially compact and lightweight and therefore easily manipulated by the user. Damage to the utility is prevented due to minimal force required to advance the probe through the soil adjacent to the utility. Further, the preferably nonconductive probe head and probe body prevent electric shock to the user should the probe contact an underground electrical utility.

The foregoing description of preferred embodiments of the present disclosure has been presented for purposes of illustration and description. The described preferred embodiments are not intended to be exhaustive or to limit the scope of the disclosure to the precise form(s) disclosed. Obvious modifications and/or variations are possible in light of the above teachings. The embodiments are chosen and described in an effort to provide the best illustrations of the principles of the disclosure and its practical application and to thereby enable one of ordinary skill in the art to utilize the concepts revealed in this disclosure in various embodiments and various modifications as are suited to the particular use contemplated. All such modifications and variations are within the scope of the disclosure as determined by the appended claims when interpreted in accordance with the breadth to which they are fairly, legally and equitably entitled.

What is claimed is:

1. A portable vibrating soil probe comprising:

a handle;

an elongate rigid probe body attached to the handle at a proximal end of the probe body;

a vibrating probe head removably attached to a distal end of the probe body, the elongate rigid probe body extending from the handle to the probe head;

a drive shaft attached to a motor at a first end of the drive shaft, the driveshaft disposed within the elongate rigid probe body and supported by one or more bearings located within the elongate rigid probe body, the drive shaft including a keyed second end that is distal from the motor; and a vibration mechanism disposed within the probe head, the vibration mechanism attached to the second end of the drive shaft, the vibration mechanism including a keyed portion shaped to engage the keyed second end of the drive shaft;

wherein the vibration mechanism induces a vibration in the probe head of the soil probe to enable the probe head to penetrate a soil surface; and wherein the elongate rigid probe body maintains a shape of the portable vibrating soil probe when the portable vibrating soil probe is inserted into the soil surface.

2. The vibrating soil probe of claim 1, wherein the motor is attached adjacent the handle of the soil probe.

3. The vibrating soil probe of claim 2, wherein the handle includes a gripping surface, a handle hub, one or more grip support members securing the gripping surface to the handle hub, and a motor output shaft adjacent the handle hub.

4. The vibrating soil probe of claim 3 further comprising one or more batteries for powering the motor.

5. The vibrating soil probe of claim 4, wherein the one or more batteries are attached to the one or more grip support members of the handle.

6. The vibrating soil probe of claim 1, wherein the handle is substantially circular shaped.

7. The vibrating soil probe of claim 1, wherein the drive shaft has a diameter that is less than a diameter of the probe head.

8. The vibrating soil probe of claim 1, wherein the vibration mechanism comprises a rotating eccentric weight, the rotating eccentric weight secured to the second end of the elongate drive shaft.

9. The vibrating soil probe of claim 1 further comprising a probe body disconnect, the probe body disconnect including a disconnect body, an insert, and a fastener, wherein the insert is attached to one of the probe body or handle and is removably inserted into the disconnect body, which is attached to one of the probe body or handle, and the fastener maintains the insert within the disconnect body such that the probe body is readily detachable from the handle.

10. The vibrating soil probe of claim 1, wherein the probe head includes a substantially tapered probe head body.

11. The vibrating soil probe of claim 10, wherein the probe head body is formed of a nonconductive material.

12. The vibrating soil probe of claim 1, wherein the probe head is threadably attached to the rigid probe body.

13. A vibrating soil probe for locating one or more underground utility conduits, the vibrating soil probe comprising:

a handle, the handle including a gripping surface, a handle hub, one or more grip support members securing the gripping surface to the handle hub and a motor output shaft adjacent the handle hub;

an elongate rigid probe body secured adjacent to the handle hub of the handle;

an elongate drive shaft secured to the motor output shaft and extending within the probe body and supported by one or more bearings located within the elongate rigid probe body, the drive shaft including a keyed second end that is distal from the motor; and a vibrating probe head removably secured adjacent a distal end of the probe body and elongate drive shaft, the vibrating probe head including a rotating eccentric weight, wherein the rotating eccentric weight includes a keyed portion shaped to engage the keyed second end of the drive shaft;

wherein the vibrating probe head has a diameter that is greater than a diameter of the elongate rigid probe body, and wherein the rotating eccentric weight induces a vibration in the probe head of the soil probe to enable the probe head to penetrate the soil;

wherein the elongate rigid probe body extends from the handle to the probe body; and wherein the elongate rigid probe body maintains a shape of the portable vibrating soil probe when the portable vibrating soil probe is inserted into the soil surface.

14. A vibrating soil probe comprising:

a circular handle, the handle including a gripping surface, a handle hub, one or more grip support members securing the gripping surface to the handle hub and a motor output shaft adjacent the handle hub, the handle further including a motor attached adjacent the handle hub and one or more batteries attached to the handle;

an elongate rigid probe body removably attached to the handle hub of the handle;

an elongate drive shaft removably attached to the motor output shaft and disposed within the probe body and supported by one or more bearings located within the elongate rigid probe body, the drive shaft including a keyed second end that is distal from the motor; and a vibrating probe head removably attached to a distal end of the probe body and elongate drive shaft, the vibrating probe head including a rotating eccentric weight, wherein the rotating eccentric weight includes a keyed portion shaped to engage the keyed second end of the drive shaft;

wherein the vibrating probe head has a diameter that is greater than a diameter of the elongate rigid probe body, and wherein the rotating eccentric weight induces a vibration in the probe head of the soil probe to enable the probe head to penetrate the soil;

wherein the elongate rigid probe body extends from the handle to the probe body; and wherein the elongate rigid probe body maintains a shape of the portable vibrating soil probe when the portable vibrating soil probe is inserted into the soil surface.

* * * * *